US005216940A

United States Patent [19]

Hedden

[11] Patent Number: 5,216,940

[45] Date of Patent: Jun. 8, 1993

[54] EXTENSION APPARATUS AND METHOD FOR OPEN ENDED WRENCH

[76] Inventor: Steven C. Hedden, 6539 E. Maria Dr., Cave Creek, Ariz. 85331

[21] Appl. No.: 915,274

[22] Filed: Jul. 20, 1992

[51] Int. Cl.[5] ..... B25B 23/00

[52] U.S. Cl. ..... 81/177.2; 81/177.85; 81/180.1; 81/121.1

[58] Field of Search ..... 81/177.1, 177.2, 177.85, 81/180.1, 185.2, 125.1, 124.7, 121.1

[56] References Cited

U.S. PATENT DOCUMENTS

| | | | |
|---|---|---|---|
| 1,119,900 | 12/1914 | Vacarezza | 81/177.85 X |
| 3,376,768 | 4/1968 | Fortunato | 81/177.2 |
| 4,817,475 | 4/1989 | Kelley et al. | 81/177.85 X |

*Primary Examiner*—D. S. Meislin
*Attorney, Agent, or Firm*—Tod R. Nissle

[57] ABSTRACT

An extension device open ended wrench permits an auxiliary wrench to be attached either above or below an open end of the wrench to lengthen the wrench handle and apply a torque to the wrench.

4 Claims, 2 Drawing Sheets

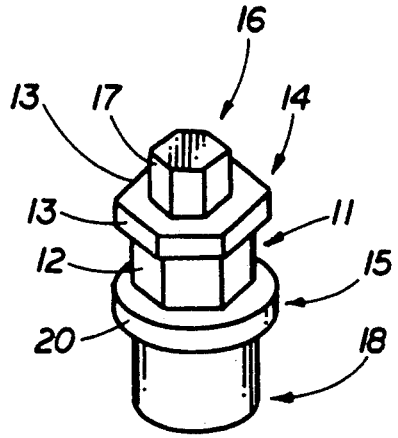
FIG. 1
FIG. 2
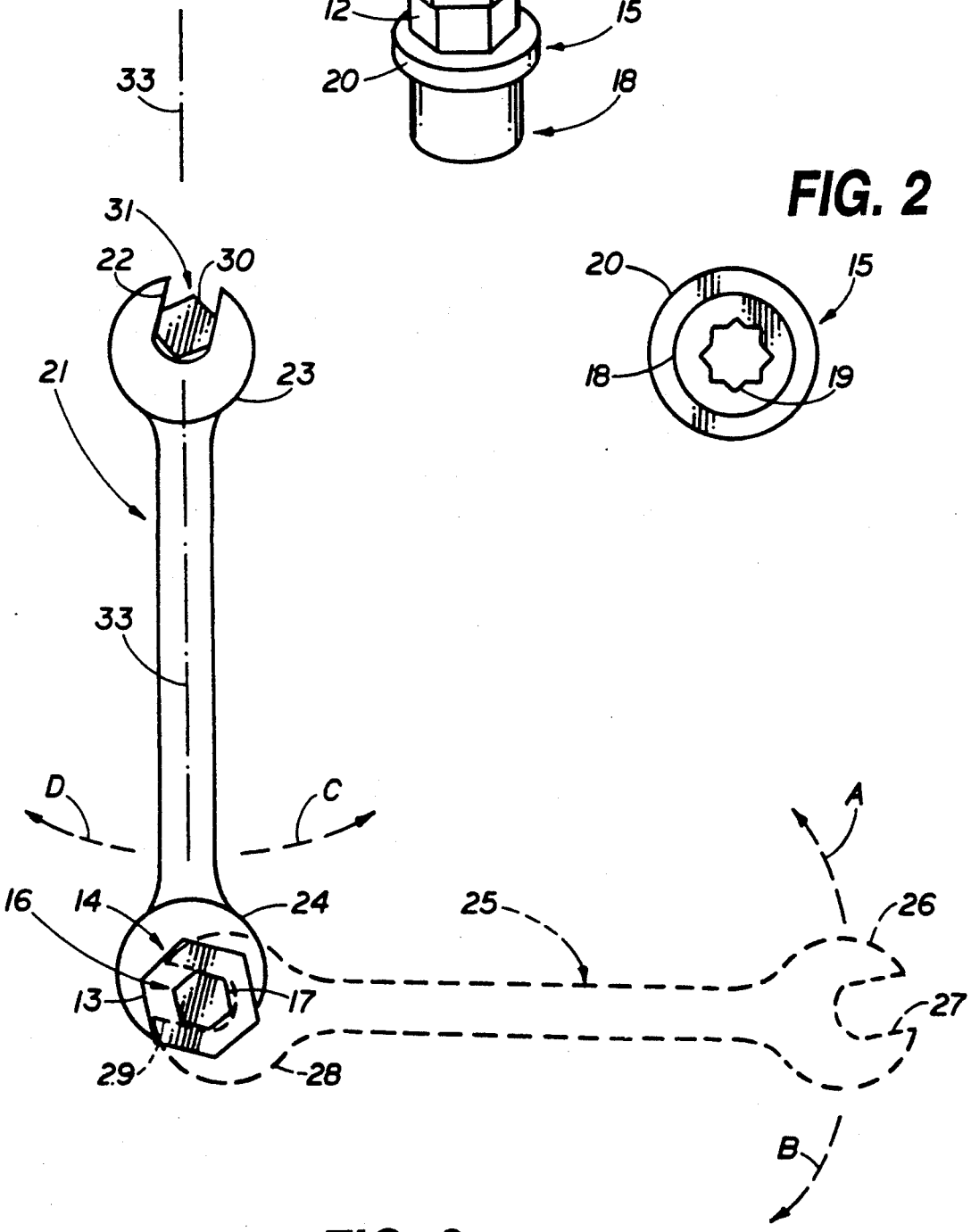
FIG. 3

EXTENSION APPARATUS AND METHOD FOR OPEN ENDED WRENCH

This invention relates to devices for extending the length of the handle of a wrench.

More particularly, the invention relates to an extension device which can engage one open end of an open ended wrench and permit an auxiliary wrench to be attached to the extension device either above or below the open ended wrench to lengthen the handle of and apply a torque to the open ended wrench.

In a further respect, the invention relates to an extension device of the type described which enables the auxiliary wrench to be attached to the extension device such that the auxiliary wrench and open ended wrench lie in a common plane generally perpendicular to the longitudinal axis of the bolt being turned by the open ended wrench.

Wrench extension devices are known in the art. See, for example, U.S. Pat. No. 4,738,167 to Ball. Wrench extender devices like the Ball device are awkward in use because the auxiliary wrench (reference character 24 in Ball) is spaced away from the primary wrench (reference character 26) in Ball being used to turn a bolt (20 in Ball). Such a spacing of the auxiliary wrench tends to produce torque forces which circumscribe the longitudinal axis of the handle of the primary wrench 26. Such circumferential torque forces twist the jaws of the primary wrench off of the head of the bolt 20. Another disadvantage of the Ball extender device is that it restricts use of the auxiliary wrench to one side of or in one position relative to the primary wrench. This restriction on the use of the auxiliary wrench is a drawback when the primary wrench is being used in a variety of hard to reach locations each of which requires that the auxiliary wrench be in a different position with respect to the primary wrench. Still a further disadvantage of the Ball extender is that it must either be slid over the distal end and up the handle or must slid upwardly through the slit in the bottom of the extender. In either case, the extender is not well suited for open ended wrenches because it either will not readily slid over the head of the wrench (which is larger than the handle) or because the handle of the wrench tends to rotate in the extender.

Accordingly, it would be highly desirable to provide an improved wrench extension device which could be readily used on an open ended wrench, would permit an auxiliary wrench to be attached to the open ended wrench to minimize the production of torque forces which cause the open ended wrench to rotate about its longitudinal axis, would permit the auxiliary wrench to be attached to the open ended wrench at a plurality of selected positions with respect to the open ended wrench, and would not require that the extension device be attached to the handle of the wrench.

Therefore, it is a principal object of the invention to provide an improved wrench extension device.

A further object of the invention is to provide an improved wrench extension device for an open ended wrench which does not have to be attached to the handle of the open ended wrench.

Another object of the invention is to provide an improved wrench extension device for an open ended wrench which permits an auxiliary wrench to be attached to the open ended wrench in a plurality of different selected positions with respect to the open ended wrench.

Still a further object of the invention is to provide an improved open ended wrench extension device which, in use, minimizes the production of torque forces which act to twist the handle of the open ended wrench about its longitudinal axis.

Yet another object of the invention is to provide an improved open ended wrench extension device which, in use, couples with the open ended wrench by slidably engaging surfaces of the wrench which normally engage and turn a bolt.

These and other, further and more specific objects and advantages of the invention will be apparent to those skilled in the art from the following detailed description thereof, taken in conjunction with the drawings, in which:

FIG. 1 is a perspective view illustrating an open ended wrench extension device constructed in accordance with the principles of the invention;

FIG. 2 is a bottom view of the wrench extension device of FIG. 1 illustrating the star shaped aperture formed in the bottom thereof to receive the square tipped drive member of a conventional ratchet wrench;

FIG. 3 is a top view illustrating the mode of operation of the extension device of the invention in conjunction with a pair of operatively associated open ended wrenches; and, FIG. 4 is a side elevation view illustrating the mode of operation of another embodiment of the invention.

Figure 4:
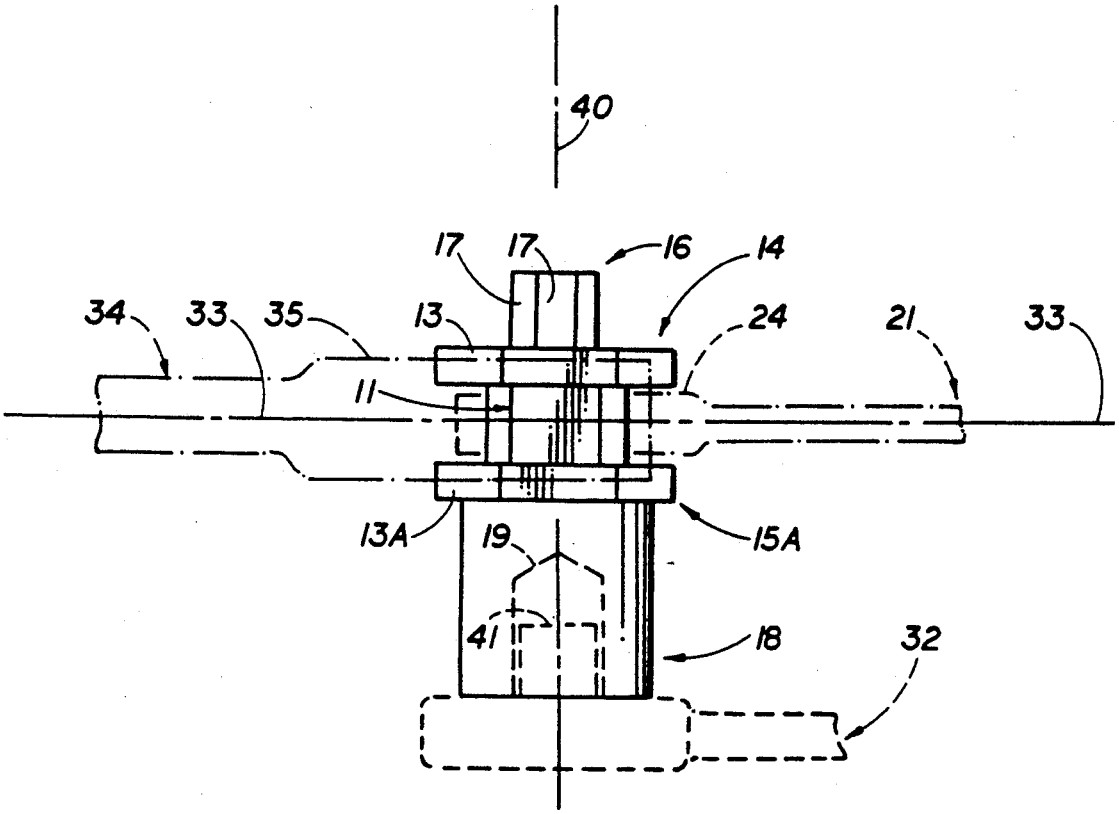

Briefly, in accordance with invention, I provide a wrench extension device for use in combination with an open ended wrench. The open ended wrench includes a first open end, a second end shaped and dimensioned to engage and turn a bolt, and a handle interconnecting the first open end and the second end. The wrench extension device functions to increase the length of the handle of the open ended wrench by using an auxiliary wrench which can be attached to the wrench extension device at either side of the first open end of the open ended wrench. The extension device comprises a unitary solid body. The body includes an intermediate portion, a first collar, a second collar, a first outer portion, and, a second outer portion.

The intermediate portion includes at least a pair of opposed parallel spaced apart sides to slidably engage and be bounded by the first open end of the wrench; an upper end; and, a lower end. The first collar is attached to and extends outwardly away from the upper end of the intermediate portion in a direction at an angle to the spaced apart sides. The second collar is attached to and extends outwardly away from the lower end in a direction at an angle to the spaced apart sides of the intermediate portion. The first outer portion is attached to one of the first and second collars; extends outwardly from the first and second collars and the intermediate portion; and, includes a hollow aperture shaped and dimensioned to slidably receive and bound the drive member of a wrench. The second outer portion is attached to the other of the first and second collars; extends outwardly from the first and second collars, the first outer portion, and the intermediate portion; and, includes at least a pair of parallel, spaced apart outer side walls shaped and dimensioned to slidably receive and be bounded by the drive member of a wrench.

Turning now to the drawings, which described the presently preferred embodiments of the invention for the purpose of illustrating the practice thereof and not by way of limitation of the scope of the invention, and in which like reference characters refer to corresponding elements throughout the several views, FIG. 1 illustrates an open ended wrench extension device constructed in accordance with the principles of the invention and comprising a unitary body typically fabricated from metal or an appropriate rigid plastic. The body includes an intermediate hexagonal portion 11 having six flat planar peripheral walls 12. Opposing spaced apart pairs of walls 12 are parallel to one another in well known fashion. Each of the six walls 12 has a size equal to the size of the remaining walls 12. The first hexagonal collar 14 is attached to the upper end of portion 11 and, like portion 11, includes six flat planar peripheral walls 13. Opposing spaced apart pairs of walls 13 are parallel to one another in well known fashion. Each of the six walls 13 has a size equal to the size of the remaining walls 13. The second collar 15 is attached to the lower end of portion 11. Collar 15 extends outwardly away from portion 11 and has a smooth cylindrical peripheral outer edge 20. If desired, collar 15 can be provided with a hex periphery which is similar to the hex periphery of collar 14. For example, in FIG. 4, collar 15A has a hex peripheral edge which is identical to the peripheral edge of collar 14. A first hexagonal outer portion 16 is attached to collar 14 and, like portion 11, includes six flat planar peripheral walls 17. Opposing spaced apart pairs of walls 17 are parallel to one another in well known fashion. Each of the six walls 17 has a size equal to the size of the remaining walls 17. Outer hex portion 16 is attached to collar 14 and is shaped such that one end of a selected open ended wrench can slidably engage and turn portion 16 in the manner illustrated in FIG. 3. Portion 16 can be shaped with five or four sides or in any other manner which enables an open ended wrench, a socket attached to the drive member of a ratchet wrench, or any other conventional wrench to engage and apply a torque force to portion 16.

Outer cylindrical portion 18 is attached to collar 15 and, as seen in FIG. 2, includes a star shaped hollow or aperture 19 which can slidably receive and engage the square drive member 41 (FIG. 4) of a conventional ratchet wrench 32 which is inserted in hollow 19. Hollow or aperture 19 can be square or take on any other shape and dimension necessary to slidably receive and engage the drive member of a wrench.

In FIG. 3, open ended wrench 21 includes end 23 with U-shaped mouth 22 for slidably engaging the hex top 30 of nut 31 to turn in conventional fashion nut 31 in to an internally threaded aperture. Wrench 21 also includes end 24 with a U-shaped mouth 22 (not visible) for slidably engaging a hex shaped member. In FIG. 3, mouth 22 of end 24 is slidably engaging hexagonal portion 11 (not visible) of the wrench extension device illustrated in FIGS. 1 and 2. The peripheral dimensions of portion 11 enable the mouth 22 of end 24 to slidably engage a pair of the opposed planar spaced apart side walls of portion 11 in the same manner that mouth 22 of end 23 slidably engages a pair of the opposed parallel opposed planar side walls of the top 30 of bolt 31 in FIG. 3. After the wrench extension device of FIG. 1 is inserted in the mouth 22 of end 24 in the manner shown in FIG. 3, a second open ended wrench, shown in ghost outline 25 in FIG. 3, is engaged with the wrench extension device by sliding the U-shaped mouth 29 of end 28 over a pair of opposed parallel planar side walls 17 of hex portion 16 in the manner illustrated in FIG. 3. Once mouth 29 engages hex portion 16, wrench 25 can be turned or torqued in the direction of arrow A or of arrow B by grabbing end 26 and pulling in the direction of arrow A or of arrow B. End 26 includes U-shaped mouth 27. When end 26 is pulled in the direction of arrow A, then the wrench extension device and end 24 of wrench 21 are pulled in the direction of arrow C in FIG. 3. When end 26 is pulled in the direction of arrow B, then end 24 and the wrench extension device are pulled in the direction of arrow D.

If desired, a different type of wrench can be utilized to engage the wrench extension device instead of open ended wrench 25. For example, a conventional ratchet wrench provided with a hex socket can be utilized. The hex socket would slidably internally receive hex portion 16 and when the handle of the ratchet wrench was pulled in the direction of arrow A, wrench 21 would be pivoted in the direction of arrow C. When the handle of the ratchet wrench was pulled in the direction of arrow B, wrench 21 would be pivoted in the direction of arrow D. Similarly, the hex socket can be removed from the square drive member 41 of the ratchet wrench and the square drive member 41 of the ratchet wrench inserted in aperture 19 so that the ratchet wrench is positioned underneath wrench 21 in the manner illustrated by dashed lines 32 in FIG. 4. In FIG. 3, wrench 25 is positioned in an upper plane which is above and parallel to the lower plane which passes through bolt top 30 and ends 23 and 24. The lower plane is parallel to the plane of the sheet of paper of the drawings. In FIG. 4, ratchet wrench 32 is positioned in a third plane which is below and parallel to said lower plane that passes through bolt top 30 and ends 23 and 24 and which is parallel to the plane of the sheet of paper of the drawings.

The wrench extension device of FIG. 4 is identical to the wrench extension device of FIGS. 1 and 2 except that the collar 15 has been replaced with a hex collar 15A having a shape and dimension identical to that of hex collar 14. The U-shaped mouth (not visible in FIG. 4) of end 35 of an open ended wrench 34 slidably fits over and engages of pair of opposed parallel peripheral walls 13 of collar 14 and fits over and engages a pair of opposed parallel peripheral walls 13A of collar 15A. Collars 14 and 15 and the U-shaped mouth of end 35 are shaped and dimensioned such that the U-shaped mouth of end 35 fits over, extends around, and is spaced apart from the outer circular peripheral edge of end 24 of wrench 21 when end 24 is in the position illustrated in FIGS. 3 and 4. The ability of the mouth of end 35 to slide onto collar 14 and/or collar 15A and slide around and over end 24 enables the longitudinal axis of the handle of wrench 34 to be co-linear with the longitudinal axis 33 of the handle of wrench 21 and minimizes the likelihood that torque forces will, when wrench 34 is pulled to rotate wrench 21 and bolt 31, be generated in a direction which circumscribes axis 33. In FIG. 4, end 35 of wrench 34 can, if desired, slidably engage only one of collars 14, 15A. The U-shaped mouth in end 35 is sized to slidably engage the walls 13, 13A of a collar 14, 15A and is too large to slidably engage a pair of opposed, spaced apart walls of hex portions 11, 16. Similarly, the U-shaped mouth in end 24 of wrench 21 in FIG. 3 is sized to slidably engage and fit a pair of opposed, spaced apart planar parallel walls 12 of portion 11 and is too large to slidably engage of pair of opposed, spaced apart planar parallel walls 17 of portion 16 and is too small to slidably engage a pair of opposed, spaced apart planar parallel walls 13 of collar 14. As would be appreciated by those of skill in the art, portions 16, 14, 11, 15A and the mouths or apertures of wrenches which engage and turn portions 14, 16, 11, 15A can be any desired size or shaped and dimension. The wrench extension device of FIG. 1 can be made in a series of gradually increasing or decreasing sizes, much like conventional socket sets. It is, however, preferred that collars 14 and 15A extend outwardly from the longitudinal axis 40 (FIG. 4) of the socket extension device past portion 11 to prevent end 24 of open ended wrench 21 from sliding off of portion 11 in a direction of travel parallel to axis 40. Collars 14 and 15 bound and house end 24 of wrench 21 in FIG. 3.

Having described my invention in such terms as to enable those skilled in the art to understand and practice it, and having identified the presently preferred embodiments thereof, I claim:

1. In combination with an open ended wrench including a first open end, a second end shaped and dimensioned to engage and turn a bolt, and a handle interconnecting said first open end and said second end, a wrench extension device to extend the length of the handle of the open ended wrench by using an auxiliary wrench said device comprising a unitary solid body including (a) an intermediate portion including (i) at least a pair of opposed parallel spaced apart sides to slidably engage and be bounded by the first open end of the wrench, (ii) an upper end, and (iii) a lower end;

(b) a first collar attached to and extending outwardly away from said upper end of said intermediate portion in a direction at an angle to said spaced apart sides;

(c) a second collar attached to and extending outwardly away from said lower end in a direction at an angle to said spaced apart sides of said intermediate portion;

(d) a first outer portion (i) attached to one of said first and second collars, (ii) extending outwardly from said one of said first and second collars and (iii) including a hollow aperture shaped and dimensioned to slidably receive and bound the drive member of a wrench; and, (e) a second outer portion (i) attached to the other of said first and second collars, (ii) extending outwardly from said other of said first and second collars, and (iii) including at least a pair of parallel, spaced apart outer side walls shaped and dimensioned to slidably receive and be bounded by the drive member of a wrench.

2. In combination with a primary open ended wrench including a first open end, a second end normally engaging a bolt to be rotated by said wrench, said bolt having an externally threaded end, said end having a longitudinal axis circumscribed by said the threads on said end, and a handle interconnecting said first open end and said second end, a wrench extension device to extend the length of the handle of the primary open ended wrench by using an auxiliary open ended wrench which can be attached to the wrench extension device colinear with the handle of the open ended wrench, the auxiliary open ended wrench including a handle and an open end, the open end of the auxiliary wrench being attached to said wrench extension device such that the handle of the auxiliary wrench is colinear with the handle of the primary wrench, said device comprising a unitary solid body including (a) an intermediate portion including (i) at least a pair of opposed parallel spaced apart sides to slidably engage and be bounded by the first open end of the primary wrench, (ii) an upper end, and (iii) a lower end;

(b) a first collar attached to and extending outwardly away from said upper end of said intermediate portion in a direction at an angle to said spaced apart sides;

(c) a second collar attached to and extending outwardly away from said lower end of said intermediate portion at an angle to said spaced apart sides, said first and second collars preventing the open end of the wrench from sliding off of said intermediate portion in a direction of travel parallel to said spaced apart sides;

at least one of said first and second collars including a pair of opposed parallel spaced apart peripheral sides shaped and dimensioned to slidably engage the open end of the auxiliary wrench to permit the auxiliary wrench to turn said one of said collars and said device.

3. The extension device of claim 2 wherein said first and second collars include means such that when said open end of said auxiliary wrench engages said one of said collars said handle of said auxiliary wrench lies in a common plane with said handle of said primary wrench, said common plane being generally perpendicular to said longitudinal axis of said bolt.

4. A method for torquing an open ended wrench including a first open end, a second end normally engaging a bolt to turn the bolt, and a handle interconnecting said first open end and said second end, said method including the steps of (a) placing a wrench extension device in the first open end of the wrench, said device comprising a unitary solid body including (i) an intermediate portion including at least a pair of opposed parallel spaced apart sides to slidably engage the first open end of the wrench, an upper end, and a lower end, (ii) a first collar attached to and extending outwardly away from said upper end of said intermediate portion in a direction at an angle to said spaced apart sides, (iii) a second collar attached to and extending outwardly away from said lower end in a direction at an angle to said spaced apart sides of said intermediate portion;

(iv) a first outer portion attached to one of said first and second collars, extending outwardly from said one of said first and second collars and including a hollow aperture shaped and dimensioned to slidably receive and bound the drive member of a selected conventional ratchet drive wrench such that said selected conventional ratchet drive wrench can apply a torque to and turn said extension device; and, (v) a second outer portion attached to the other of said first and second collars, extending outwardly from said other of said first and second collars, and including at least a pair of parallel, spaced apart outer side walls shaped and dimensioned to slidably receive and be bounded by the drive member of a selected open ended wrench such that said selected open ended wrench can apply a torque to and turn said extension device;

(b) a wrench pair consisting of said selected conventional ratchet drive wrench and said selected open ended wrench selecting one of said wrenches of said wrench;

(c) sliding the drive member of said selected wrench into an appropriate one of (i) said hollow aperture of said first outer portion, and, (ii) said pair of parallel, spaced apart outer side walls of said second outer portion to engage said wrench extension device; and, (d) applying a torque to said selected wrench to turn said extension device, said primary open ended wrench, and said bolt.

* * * * *